US007990240B2

(12) United States Patent
Bush et al.

(10) Patent No.: US 7,990,240 B2
(45) Date of Patent: Aug. 2, 2011

(54) EPOXY SEALED RELAY

(75) Inventors: Bernard Victor Bush, Santa Barbara, CA (US); Jeremiah Garcia Reyes, Santa Barbara, CA (US)

(73) Assignee: Tyco Electronics Corporation, Middletown, PA (US)

( * ) Notice: Subject to any disclaimer, the term of this patent is extended or adjusted under 35 U.S.C. 154(b) by 577 days.

(21) Appl. No.: 11/874,739

(22) Filed: Oct. 18, 2007

(65) Prior Publication Data

US 2009/0101385 A1 Apr. 23, 2009

(51) Int. Cl.

| | |
|---|---|
| ***H01H 67/02*** | (2006.01) |
| ***H01H 51/22*** | (2006.01) |
| ***H01H 1/66*** | (2006.01) |
| ***H01R 4/58*** | (2006.01) |
| ***H01R 13/52*** | (2006.01) |

(52) U.S. Cl. ..... 335/132; 335/78; 335/151; 439/89; 439/271

(58) Field of Classification Search ..... 335/78–86, 335/124, 126, 128, 132, 151–154; 200/302.1, 200/304, 305; 439/89, 271–277
See application file for complete search history.

(56) References Cited

U.S. PATENT DOCUMENTS

| | | | | |
|---|---|---|---|---|
| 2,906,986 | A | 9/1959 | Schaefer | |
| 3,891,950 | A * | 6/1975 | De Lucia | 335/151 |
| 4,039,984 | A * | 8/1977 | DeLucia et al. | 335/151 |
| 4,573,030 | A * | 2/1986 | Schubert | 335/156 |
| 4,786,762 | A * | 11/1988 | Bowsky et al. | 174/152 GM |
| 5,145,417 | A * | 9/1992 | Honkomp et al. | 439/685 |
| 5,984,724 | A | 11/1999 | McNeel | |
| 6,265,955 | B1 | 7/2001 | Molyneux et al. | |
| 6,372,993 | B1 * | 4/2002 | Eckels et al. | 174/152 GM |
| 6,844,502 | B2 * | 1/2005 | Deng et al. | 174/151 |
| 7,321,281 | B2 * | 1/2008 | Molyneux et al. | 335/202 |
| 2002/0097119 | A1 * | 7/2002 | Molyneux et al. | 335/202 |
| 2006/0261916 | A1 * | 11/2006 | Molyneux et al. | 335/128 |

FOREIGN PATENT DOCUMENTS

| | | |
|---|---|---|
| DE | 70 01 065 U | 8/1973 |
| WO | WO 97/32325 | 9/1997 |

* cited by examiner

*Primary Examiner* — Anh T Mai
*Assistant Examiner* — Mohamad A Musleh

(57) ABSTRACT

A relay assembly is provided that includes an intermediate member to aid in coupling a wire to a housing.

17 Claims, 4 Drawing Sheets

EPOXY SEALED RELAY

FIELD

The present disclosure is related generally to relays. The present disclosure is more specifically related to hermetically sealed relays.

BACKGROUND AND SUMMARY

Hermetically sealed electromagnetic relays are used for switching of high electrical currents and/or high voltages, and typically have fixed and movable contacts, and an actuating mechanism supported within a hermetically sealed chamber. To suppress arc formation, and to provide long operating life, air is removed from the sealed chamber by conventional high-vacuum equipment and techniques. In one style of relay, the chamber is then sealed so the fixed and movable contacts contact in a high-vacuum environment. In another common style, the evacuated chamber is backfilled (and sometimes pressurized) with an insulating gas (e.g., sulphur hexafluoride) with good arc-suppressing properties.

For purposes of this disclosure, a hermetic seal means a seal which is sufficiently strong and impermeable to maintain for a long term a high vacuum of $10^{-5}$ Torr (760 Torr=one atmosphere) or less, and a pressure of at least 1.5 atmospheres.

In one embodiment described below, a sealed electromagnetic relay assembly is provided comprising a first relay having a plurality of leads for connection to external circuitry; a plurality of permanent magnets coupled to the first relay proximate to first and second contacts; and a hermetically sealed housing assembly enclosing the first relay. The housing assembly comprises: an upper closure including an evacuation tube in fluid communication with an interior chamber of the housing assembly, wherein ambient air may be evacuated from the housing assembly to a vacuum and wherein the housing assembly, after evacuation, is backfilled with an insulative gas to a pressure of greater than 1.5 atmospheres; and an impermeable potting cup surrounding the first relay and permanent magnets, the potting cup being adapted to receive the first relay at one end and being open at the other end for the receipt of encapsulating material and engagement with the upper closure, wherein the encapsulating material seals the housing assembly against ambient air intrusion, and the relay leads extend outwardly from the housing assembly.

In another embodiment of the present disclosure, a method of producing a relay assembly is provided including the steps of: providing a first relay having a rating of 30V or less for hotswitching; coupling permanent magnets in proximity to fixed and moveable contacts of the first relay so as to create a magnetic field between the fixed and moveable contacts when the fixed and moveable contacts are spaced apart; sealing the first relay within a vessel; evacuating substantially all ambient air from the vessel; and backfilling the vessel with a desired gas.

DETAILED DESCRIPTION

Figure 1A:
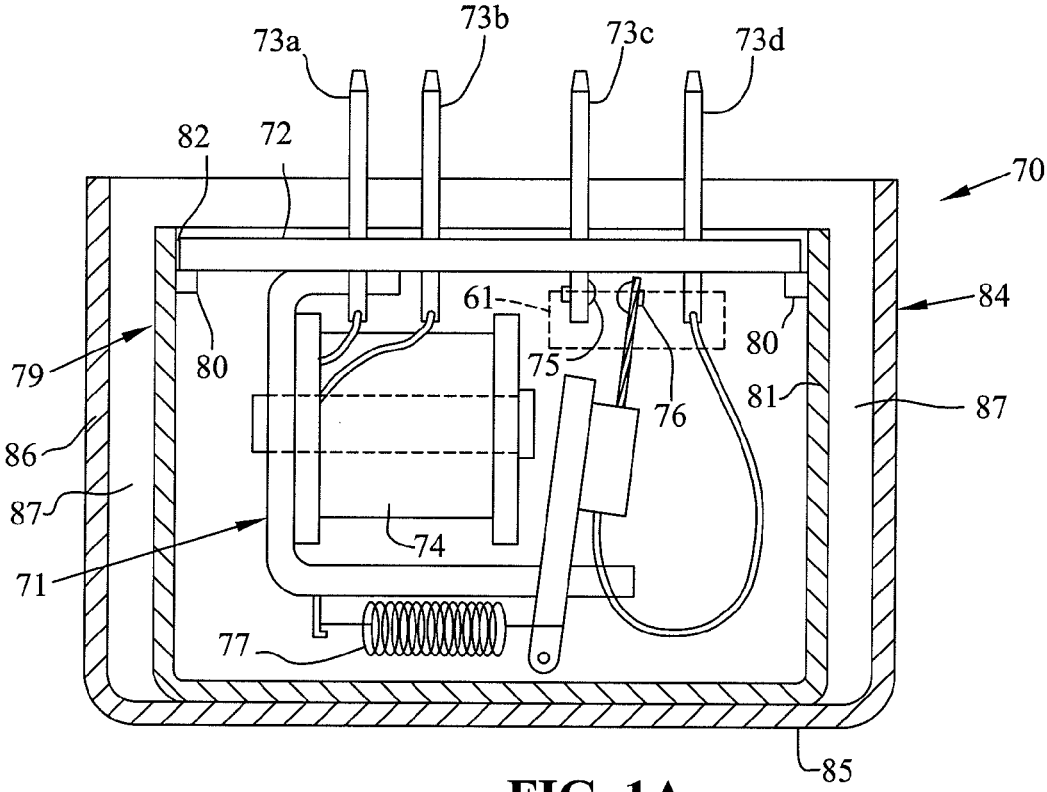
FIGS. 1A and 1B are respectively a sectional side elevation and a top view of an open-frame relay in a plastic cup supported in an outer metal cup, the assembly being shown before encapsulation.
Figure 1B:
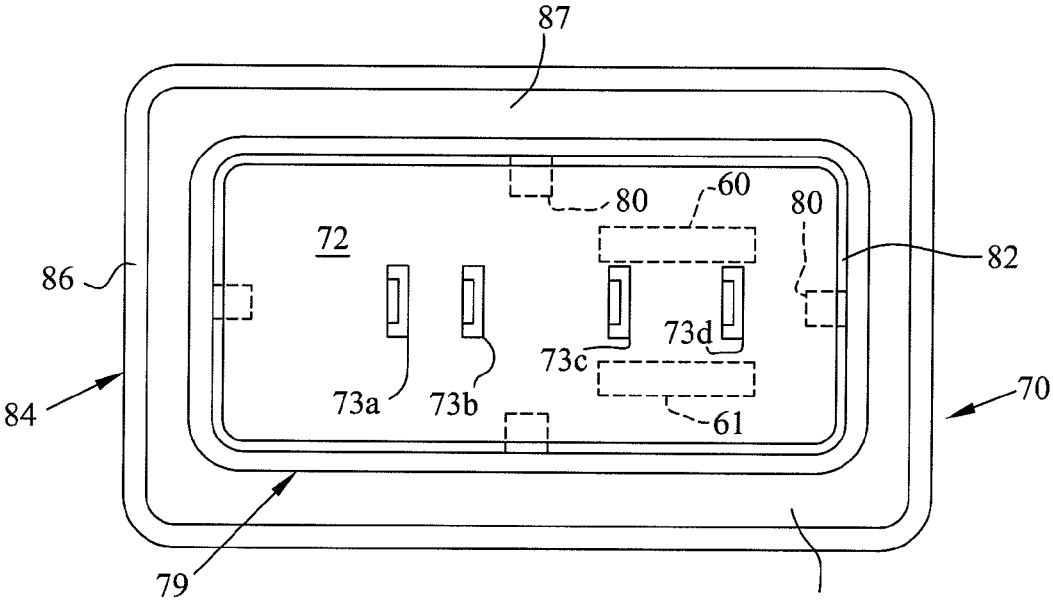
Figure 2:
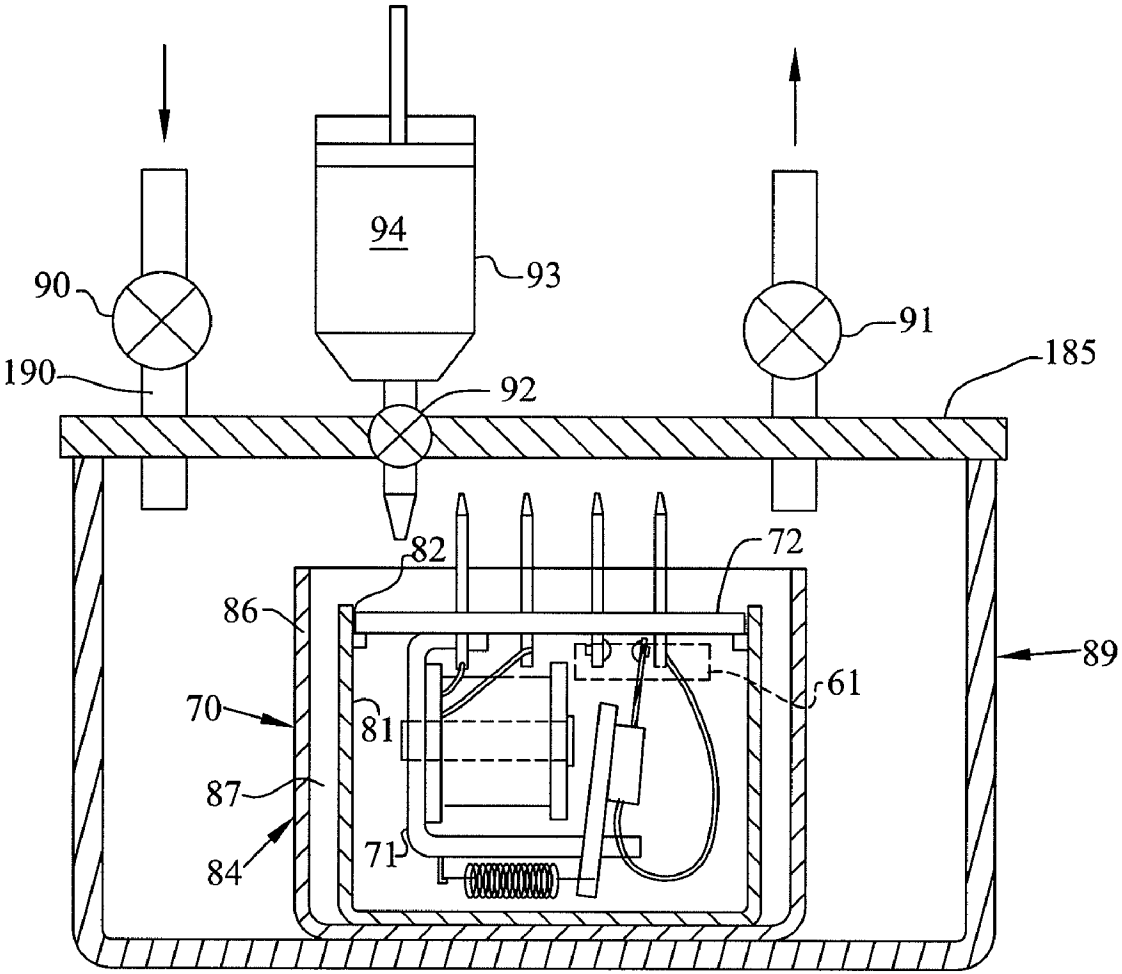
FIG. 2 shows the assembly of FIGS. 1A and B in a closed chamber having evacuation, pressurization and encapsulation-material valves.
Figure 3:
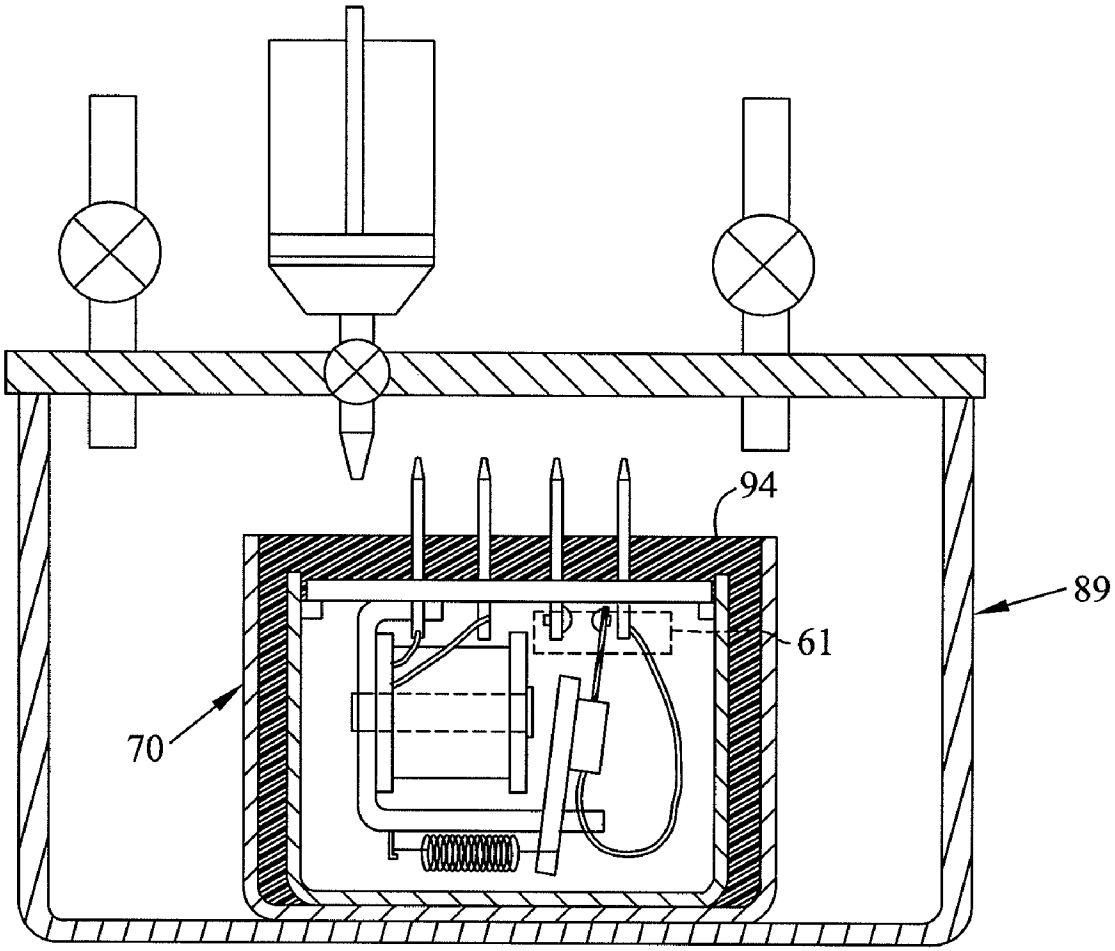
FIG. 3 is a view similar to FIG. 2, and showing the relay assembly filled with cured encapsulation material.

A sealed relay according to the disclosure is shown in FIGS. 1-3, and this embodiment uses a simple and inexpensive open-frame relay in an open-top housing assembly which is evacuated, encapsulated and backfilled while positioned within a sealed chamber. This manufacturing method eliminates need for an evacuating and backfilling tubulation, and enables use of an inexpensive relay for high-voltage and high-power applications heretofore handled only by more expensive high-vacuum or pressurized units of known types as described in the introductory part of this specification.

Referring to FIGS. 1A and B, relay assembly 70 is shown prior to encapsulation, and the assembly includes a conventional open-frame relay 71 (illustrated as a single-pole single-throw or SPST type, but other conventional contact configurations are equally useful) secured to and suspended from a generally rectangular header 72. Relay 71 in the present embodiment is rated for 30V or less hotswitching and is not hermetically sealed.

Elongated metal terminal pins 73*a*-*d* extend through the header, and pins 73*a* and *b* are connected to a coil 74 of the relay electromagnetic actuator. Pin 73*c* supports a fixed contact 75, and pin 73*d* is connected to a movable contact 76 which is pulled against the fixed contact when the relay is energized. A coil spring 77 urges the movable contact into an open position in conventional fashion. Permanent magnets 60, 61 (shown in phantom so as to not obscure contacts 75, 76) are added to relay 71 and are positioned on opposing sides of fixed and moveable contacts 75, 76. Magnets 60, 61 are oriented to create a magnetic field across the gap, when present, between fixed and moveable contacts 75, 76. Magnets 60, 61 are equally distant from fixed and moveable contacts 75, 76 and provide arc quenching equally well regardless of current polarity.

Relay 71 is positioned within an open-top plastic cup 79, with the underside of header 72 supported on short spaced-apart lugs 80 which extend inwardly from the inner perimeter of a sidewall 81 of cup 79 slightly below the top of the cup. The header does not make a snug press fit within the upper end of the cup, and there is instead an intentional narrow gap 82 of say 0.002-0.003 inch between the side edges of the header and the inner surface of sidewall 81.

Plastic cup 79 is in turn centrally fitted within an open-top metal cup 84 having a base 85 against which the plastic cup rests, and an upwardly extending sidewall 86. The plastic cup is smaller in external dimension than the interior of sidewall 86, creating a space or gap 87 between the plastic and metal cups. Sidewall 86 extends higher than the top of the plastic cup, and pins 73*a*-*d* in turn extend higher than the top of the metal cup. An acceptable alternative to metal cup 84 is a similarly shaped plastic cup having a separate metal plate resting on the cup bottom for bonding with encapsulation material.

The thus-assembled components are next placed in a sealed chamber 89 including base 185 as shown in FIG. 2. The chamber has an evacuation valve 90 disposed in an evacuation tube 190 connected to a high-vacuum pumping system (not shown) of a conventional type using mechanical and diffusion pumps. The chamber also has a pressurization valve 91 connected to a pressurized source (not shown) of an insulating gas such as $SF_6$. The chamber further has a third valve 92 positioned above cup 84, and connected to a piston-cylinder assembly 93 for holding and delivering a metered amount of uncured viscous, but fluid encapsulating material 94.

Evacuation valve 90 is then opened, and the high-vacuum pumping system actuated to withdraw air from the chamber interior to a vacuum which is preferably at least $10^{-2}$ to $10^{-3}$ Torr if the relay is to be backfilled. Ambient air is simultaneously withdrawn from relay assembly 70 through gap 82 between header 72 and sidewall 81. Valve 90 is closed when a desired vacuum is achieved.

Open-frame relays are unsuited for long-term vacuum operation due to outgassing of components such as the relay coil which will eventually contaminate and adversely affect a high-vacuum environment. This problem is eliminated by backfilling and pressurizing the chamber and as-yet-unsealed relay assembly with an insulating gas which is admitted by opening pressurization valve 91. The gas flows freely through gap 82 to fill and pressurize the interior of the relay assembly.

With the chamber interior stabilized in a high-pressure condition, valve 90 is closed, valve 92 is opened, and piston-cylinder assembly 93 actuated to deliver at a pressure exceeding that of the pressurized chamber a metered amount of fluid encapsulating material into metal cup 84 to completely fill gap 87 and cup 84 to a level just beneath the top of sidewall 86 as shown in FIG. 3. The encapsulating material is too viscous to pass through small gap 82, and the backfilled environment within the relay assembly remains undisturbed.

Preferably, chamber 89 is of a conventional type which includes a heater such as an induction heater, and heat is applied to the now-encapsulated relay assembly to cross link and cure the encapsulating material. With the chamber vented to atmosphere, the completed relay assembly is removed for testing and packaging. In production, many relay assemblies would be processed in a single loading of the chamber, and the methods of the disclosure can also be adapted for use in a continuous production line.

The optimum environment in which the relay contacts make and break is dependent upon the required performance of the relay. Vacuum (less than $10^{-5}$ Torr) is generally a good environment for high-voltage applications, but would not be chosen for applications where relay components in the vacuum environment might outgas. There are many gases that can be used to improve electrical performance of a relay. Sulfur hexafluoride ($SF_6$) is a good dielectric gas which at higher pressure will standoff significantly higher voltages than open air. A relay that will standoff 5 kilovolts in open air will standoff 40 kilovolts if it is pressurized with 10 atmospheres of $SF_6$. Another characteristic of $SF_6$ is that once ionized it becomes an excellent conductor. This makes it a good choice for relays that need to make into a load and keep consistent conduction of current while the load is being discharged.

Hydrogen (and hydrogen-nitrogen blends) has been shown to effectively cool the electrical arc that is created when the electrical contacts move away from each other while breaking a load. The difficulty with hydrogen is that not only is it the smallest molecule so that it will propagate through the smallest cracks, but it can also chemically propagate through many materials. The design of the present disclosure using cross-linked polymers, unlike other designs, will hold pressurized hydrogen gas for many years.

There are several kinds of epoxy materials which bond satisfactorily with metal and, which are impermeable to prevent leakage of air into a vacuum relay, or loss of insulating gas in a pressurized relay. A material that is commercially available is provided under the trademark Resinform RF-5407 (75% alumina filled) mixed 100:12 by weight with Resinform RF-24 hardener. Alternative epoxy materials may provide these characteristics:

a. Low gas permeability (less than $10^{-10}$ standard cubic centimeters of air per second).

b. High dielectric strength (greater than 100 volts per mil).

c. Low outgassing (to maintain a vacuum of $10^{-5}$ Torr or better).

d. Good mechanical strength.

e. Thermal expansion characteristics reasonably matched to those of the metal with which the epoxy forms a hermetic seal.

Whereas initial relay 71 is rated for 30V or less hotswitching, the resulting relay assembly 70, via the pressurization and permanent magnets 60, 61, is rated for 48V or greater hotswitching. Accordingly, a relatively inexpensive high performance relay assembly 70 is provided.

Figure 4:
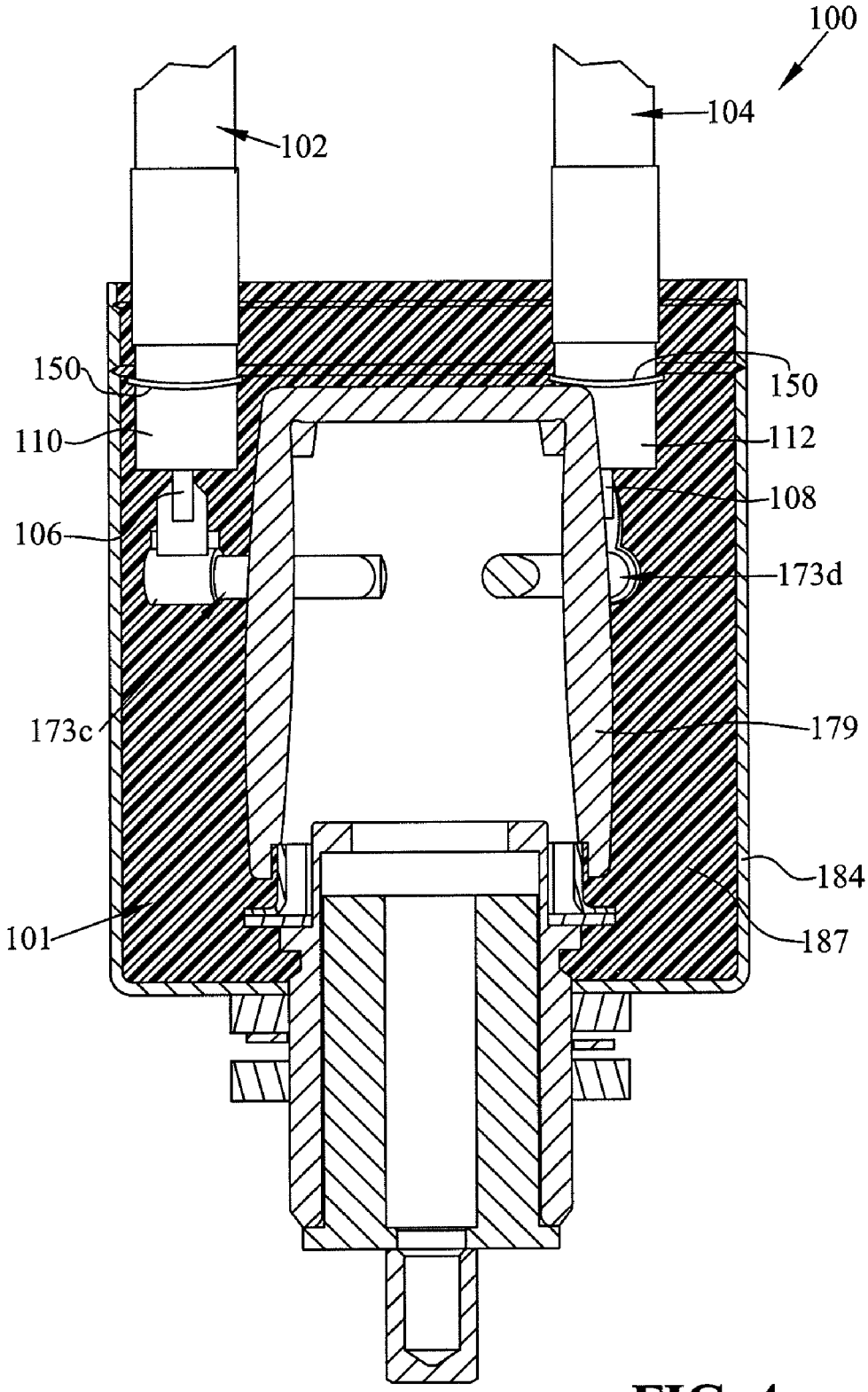
FIG. 4 is a cross-sectional view of a wire-relay interface.

FIG. 4 shows relay 100 having a dielectric seal for coupling electrical leads to relay 100. FIG. 4 shows relay 100 where space or gap 187 between inner cup 179 and outer potting cup 184, similar to space/gap 87 of relay assembly 70, is filled with epoxy material 101.

Relay 100 receives jacketed wires 102, 104 secured in the epoxy. The relay mechanism in relay 100 is standard, and as such, is not shown. Wires 102, 104 have conductive cores 106, 108 and non-conductive sheaths 110, 112. Conductive cores 106, 108 electrically couple to terminal pins 173*c*, 173*d*. Non-conductive sheaths 110, 112 are exemplarily shown as either plastic or silicone. Plastic and silicone are relatively pliable and compressible. Accordingly, subsequent to being secured within epoxy 101, sheaths 110, 112 may distort and allow foreign material, including conductive material (not shown) to enter any gaps between sheaths 110, 112 and epoxy fill/shell 101. Infiltration of such conductive material may allow arcing and circuit completion between wires 102, 104 outside of relay 100.

Metal rings 150 are provided proximate ends of wires 102, 104. Metal rings 150 generally approximate flat washers. Metal rings 150 have an outer diameter approximately equal to the outer diameter of wires 102, 104 and inner diameters greater than inner diameters of non-conductive sheaths 110, 112. Accordingly, metal rings 150 are electrically isolated from conductive cores 106, 108.

The bonding properties between metal and epoxy as well as between metal and silicone/plastic are superior in strength and reliability to the bonding properties between epoxy and silicone/plastic. Accordingly, metal rings 150 provide an intermediary to which both epoxy and sheaths 110, 112 may adhere more reliably than an epoxy-sheath direct bond.

If foreign material infiltrates from the exterior of relay 100 between epoxy 101 and non-conductive sheaths 110, 112, such foreign material is prevented from extending beyond metal rings 150 due to the superior bonding between rings 150 and epoxy 101 and sheaths 110, 112. Furthermore, rings 150 are positioned at such a distance from conductive cores 106, 108 and with non-conductive intermediaries therebetween to maintain electrical isolation of cores 106, 108 in most all applications.

Whereas rings 150 have been described as being disposed within epoxy filled gaps of relay 100, such rings 150 may also be disposed within an exterior wall of sealed chamber 89 of relay assembly 70 or other similar structures in other relays.

There have been described several embodiments of epoxy envelopes for hermetically sealing standard relay designs in a special atmosphere for improved performance. These envelopes provide significant cost savings in the manufacture of vacuum or pressurized sealed relays, and have performance characteristics at least equivalent to relays of this type using glass or ceramic envelopes. The disclosure is not limited to the specific relay types described above, and is equally useful with other switching devices such as reed-style relays and the like.

The invention claimed is:

1. A sealed electromagnetic relay assembly comprising:

a wire including a conductor and an insulative jacket;

an epoxy housing receiving the wire therein; and an intermediate member, the intermediate member being in a surrounding relationship with the wire, the intermediate member having an inner surface directly coupled to the jacket, the intermediate member being spaced apart from the conductor by the jacket at all times, and the intermediate member having an outer surface directly coupled to the epoxy housing, the intermediate member being formed of a material that adheres to the epoxy with a first strength and adheres to a material of the insulative jacket with a second strength, the first and second strengths being stronger than a third strength that is the strength of adherence between the epoxy and the material of the insulative jacket.

2. The assembly of claim 1, wherein the insulative jacket is made of silicone.

3. The assembly of claim 1, further including a first pole within the housing and fixedly electrically coupled to the conductor.

4. The assembly of claim 1, wherein the intermediate member is a ring.

5. The assembly of claim 1, wherein the intermediate member is metallic.

6. The assembly of claim 1, wherein the intermediate member is a ring having an outer diameter and an inner diameter, the outer diameter being substantially equal to an outer diameter of the insulative jacket and the outer diameter being substantially different than the inner diameter.

7. The assembly of claim 1, wherein the intermediate member is separate from the housing and the intermediate member is a flat and thin planar member from the inner surface to the outer surface.

8. A method of coupling a wire to an epoxy member including the steps of:

providing an epoxy member;

providing a wire having a conductor and an insulative jacket, the insulative jacket being flexible and surrounding substantially all portions of the wire located outside of the epoxy member; providing an intermediate member formed from a material that adheres to the epoxy with a first strength and adheres to a material of the insulative jacket with a second strength, the first and second strengths being stronger than a third strength that is the strength of adherence between the epoxy and the material of the insulative jacket, coupling the intermediate member to a first portion of the insulative jacket; and coupling the intermediate member to a first portion of the epoxy member.

9. The method of claim 8, wherein the step of coupling the intermediate member to the first portion of the insulative jacket causes the intermediate member to encircle the conductor.

10. The method of claim 8, wherein the intermediate member is a ring having an outer diameter substantially equal to an outer diameter of the insulative jacket.

11. The method of claim 8, wherein the intermediate member is a ring having an inner diameter greater than an outer diameter of the conductor.

12. The method of claim 8, further including the step of abutting a second portion of the insulative jacket to a second portion of the epoxy housing.

13. The method of claim 12, wherein the abutting step includes adhering the insulative jacket to the epoxy.

14. A sealed electromagnetic relay assembly comprising:

a wire including a conductor and an insulative jacket;

an epoxy housing having a first pole therein and receiving the wire therein, the insulative jacket being flexible and compressible and surrounding substantially all portions of the wire located outside of the epoxy member; and means for sealing the wire to the housing formed of a material that adheres to the epoxy with a first strength and adheres to a material of the insulative jacket with a second strength, the first and second strengths being stronger than a third strength that is the strength of adherence between the epoxy and the material of the insulative jacket, the means for sealing having an inner surface directly coupled to the jacket, the means for sealing being spaced apart from the conductor by the jacket at all times, and the means for sealing having an outer surface directly coupled to the epoxy housing.

15. The assembly of claim 14, wherein the means for sealing is in a surrounding relationship with the wire.

16. The assembly of claim 14, wherein the means for sealing is a substantially flat and thin planar ring.

17. The assembly of claim 14, wherein the means for sealing has an inner diameter larger than an outer diameter of the conductor and the means for sealing has an outer diameter equal to or larger than an outer diameter of the insulative jacket.

* * * * *